US006168159B1

(12) United States Patent
Kulick

(10) Patent No.: US 6,168,159 B1
(45) Date of Patent: Jan. 2, 2001

(54) APPARATUS AND METHOD FOR PLAYING A MATCHING GAME

(76) Inventor: Lorie L. Kulick, 4005 Kingsway Dr., Crown Point, IN (US) 46307

( * ) Notice: Under 35 U.S.C. 154(b), the term of this patent shall be extended for 0 days.

(21) Appl. No.: 09/321,031

(22) Filed: May 27, 1999

(51) Int. Cl.[7] ..... A63F 3/00; A63F 9/18
(52) U.S. Cl. ..... 273/273; 273/258; 273/429
(58) Field of Search ..... 273/236, 242, 273/258, 273, 429, 430

(56) References Cited

U.S. PATENT DOCUMENTS

| | | | |
|---|---|---|---|
| 4,635,939 | 1/1987 | Makow | 273/296 |
| 5,054,775 | 10/1991 | Banks et al. | 273/431 |
| 5,120,066 | 6/1992 | Cohen | 273/258 |
| 5,297,801 | 3/1994 | Croker | 273/430 |

FOREIGN PATENT DOCUMENTS

| | | | |
|---|---|---|---|
| 2669836 * | 6/1992 | (FR) | 273/273 |

* cited by examiner

*Primary Examiner*—John A. Ricci
(74) *Attorney, Agent, or Firm*—Bell, Boyd & Lloyd LLC

(57) ABSTRACT

The present invention reveals a game for utilizing common knowledge and the English language to match the answers of one's teammates to the word or phrase given on a match card. The number of possible answers is endless as there is no right or wrong answer to the word or phrase on the match cards, it depends entirely upon what each individual comes up with for his or her answer. Points are awarded when one or more teammates match the answer given by the person who reads the match card and who rolled a die. When answers are matched, that team moves its game piece along the game board corresponding to the number of points earned from the number of matching answers.

22 Claims, 2 Drawing Sheets

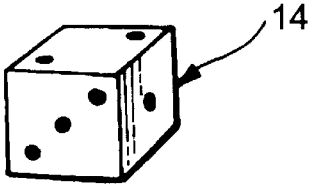
FIG. 2
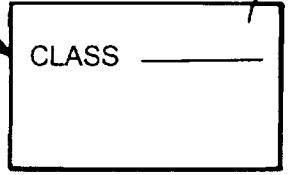
FIG. 3
FIG. 4
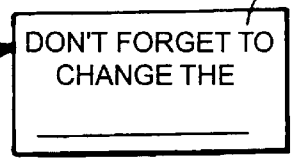
FIG. 5
FIG. 6
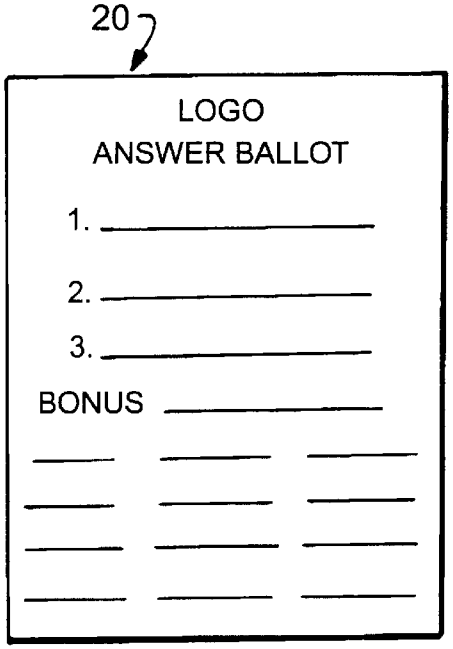
FIG. 7
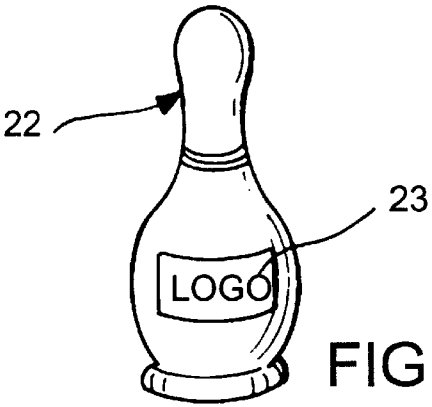
FIG. 8

APPARATUS AND METHOD FOR PLAYING A MATCHING GAME

DESCRIPTION

The present invention relates in general to an apparatus and method for playing a matching game, and in particular to an apparatus and method for playing a matching game wherein team members obtain points and advance on a game board by matching one of their teammates' answers and wherein the team which advances furthest on the board after a pre-determined number of rounds wins the game.

BACKGROUND OF THE INVENTION

People are always seeking new, exciting and educational methods to entertain themselves, their family and their friends. Too often, when people gather, they entertain themselves by watching television. This limits the interaction between people. To enhance the interaction between people, numerous games have been developed. Board games such as Monopoly® and Trivial Pursuit® have been extremely successful. However, many board games have been unsuccessful because they are too complicated, require specialized knowledge on particular subjects or are simply not exciting or fun to play. Accordingly, there is a need for an exciting, educational and fun board game for groups of people to play.

To address this problem, several board games have been developed. For example, (i) U.S. Pat. No. 4,635,939 entitled "Question and Answer Game Apparatus and Method"; (ii) U.S. Pat. No. 5,054,775 entitled "Game Relating to Personal Relationships"; (iii) U.S. Pat. No. 5,120,066 entitled "Method of Playing a Thesaurus Game"; and (iv) U.S. Pat. No. 5,297,801 entitled "Synonym and Antonym Question and Answer Board Game" disclose a variety of games. None of these games disclose the matching game of the present invention.

It is also well known that a television game show entitled "Match Game" was televised for several years. The game included two contestants or players who competed against each other, six semi-famous panelist and a host. The players tried to match the answers given by the panelist to incomplete expressions or phrases. The players earned dollars by matching the panelist answers to the incomplete expressions. The player with the most dollars after a predetermined period of time won the game and kept their winnings. The winner then had an opportunity to win additional prize money by picking a panelist and matching the panelist's answer to an additional incomplete expression or phase. However, the televised "Match Game" does not disclose, teach or suggest the apparatus or method for playing the matching game of the present invention.

SUMMARY OF THE INVENTION

The apparatus and method of the present invention provides an educational, exciting and entertaining matching game which utilizes common knowledge and the English language. The overall object of the game is for each team to obtain points by matching the answers given by one of the player's teammates to complete certain expressions or phrases. The number of possible answers to complete the expressions or phrases is unlimited. There are no right or wrong answers and the players do not need specialized knowledge in any particular subject matter. The answers depend entirely upon what each player thinks is the best way to complete the expression or what each player expects the other players on his or her team to think is the best way to complete the expression. The matching game makes the players interact with each other and develop better language skills.

A team obtains points when one or more of the teammates match the answer given by a selected teammate (i.e., the "reader") who reads an incomplete expression or phrase (i.e., an "incomplete expression") from a selected match card. A match may be worth different point values depending on the difficulty of the incomplete expression, on the outcome of a roll of a die or dice, or on other variables. The game is divided into a plurality of rounds, preferably including three regular rounds and one bonus round. A regular round consists of each player on each team taking a turn as the reader of the incomplete expression on the match card. After the regular rounds, the players play a bonus round. The bonus round consists of one player on each team taking a turn as the reader of the incomplete expression on the match card. After the bonus round, the winner of the game is the team which has advanced furthest on the board by obtaining the most points.

The preferred embodiment of the apparatus of the present invention includes a game board, a die, a plurality of match cards, a plurality of answer ballots and a plurality of game pieces. The game board preferably includes one-hundred forty-four consecutively numbered spaces. The die preferably is a six-sided die having two sides with one dot, two sides with two dots and two sides with three dots, respectively representing one point, two points and three points. The match cards include a deck of 1 & 2 point match cards and a deck of 3 point match cards. The 1 & 2 point match cards preferably include one incomplete expression and the 3 point match cards preferably include one incomplete expression. The game pieces preferably include a plurality of differently colored or shaped pieces which are adapted to, represent and distinguish each team. The answer ballots enable each player to secretly write their answers to each of the incomplete expressions in each round.

The method for playing the matching game of the present invention includes the general steps of selecting at least two teams comprised of at least two players per team, selecting a game piece for each team, playing three regular rounds of the matching game, playing one bonus round of the matching game and determining the winning team. It should be appreciated that the number of regular rounds and the number of bonus rounds could vary in accordance with the present invention.

The first regular round includes the steps of: (i) selecting a player from a team to be the reader; (ii) the reader rolling the die to determine the point value of a match during the reader's turn and to determine which type of match card to select; (iii) the reader selecting a 1 & 2 point match card or a 3 point match card, based on the outcome of the roll of the die; (iv) the reader reading the incomplete expression on the selected match card; (v) the reader and each player on the same team as the reader (i.e., the "reader's teammates") writing down their answer on the answer ballot to the incomplete expression on the match card read by the reader; (vi) comparing the answer of the reader with the answers of reader's teammates; (vii) calculating points to be awarded according to the value of the match and the number of matches of the reader's teammates with the answer of the reader; (viii) advancing the team's game piece on the game board according to the number of points awarded to the team; and (ix) repeating the above steps for each player on each team, whereby each player has had a turn at being the reader and the teams rotate turns. The second and third regular rounds of the matching game are played by repeating the steps of the first round.

The bonus round includes the steps of: (i) selecting a player from a team to be the reader in the bonus round; (ii) the reader rolling the die to determine the point value of the match in the bonus round; (iii) the reader randomly selecting a 3 point match card; (iv) the reader reading the incomplete expression on the selected 3 point match card; (v) the reader and the reader's teammates writing down their answers on the answer ballot to the incomplete expression on the match 3 point card read by the reader; (vi) comparing the answer of the reader with the answers of reader's teammates; (vii) calculating points to be awarded according to the value of the match and the number of matching answers; and (viii) advancing the team's game piece on the game board according to the number of points awarded to the team. The above steps are repeated in the bonus round for each of the other teams. In the bonus round, a "one" on the die is worth ten points per match, a "two" on the die is worth twenty points per match and a "three" on the die is worth thirty points per match. After the bonus round, the team which has advanced furthest on the board wins the game.

It is therefore an object of the present invention to provide an apparatus for playing a matching game.

A further object of the present invention is to provide a method for playing a matching game.

Other objects, features and advantages of the invention will be apparent from the following detailed disclosure, taken in conjunction with the accompanying sheets of drawings, wherein like numerals refer to like parts.

BRIEF DESCRIPTION OF THE DRAWINGS

FIG. 2 is a perspective view of a six-sided die having two sides with one dot, two sides with two dots and two sides with three dots;

FIG. 3 is a top plan view of a 1 & 2 point match card;

FIG. 4 is a bottom plan view of an example of a 1 & 2 point match card;

FIG. 5 is a top plan view of a 3 point match card;

FIG. 6 is a bottom plan view of an example 3 point match card;

FIG. 7 is a top plan view of an answer ballot; and

FIG. 8 is front plan view of a game piece of the matching game of the present application.

DETAILED DESCRIPTION OF THE INVENTION

Figure 1:
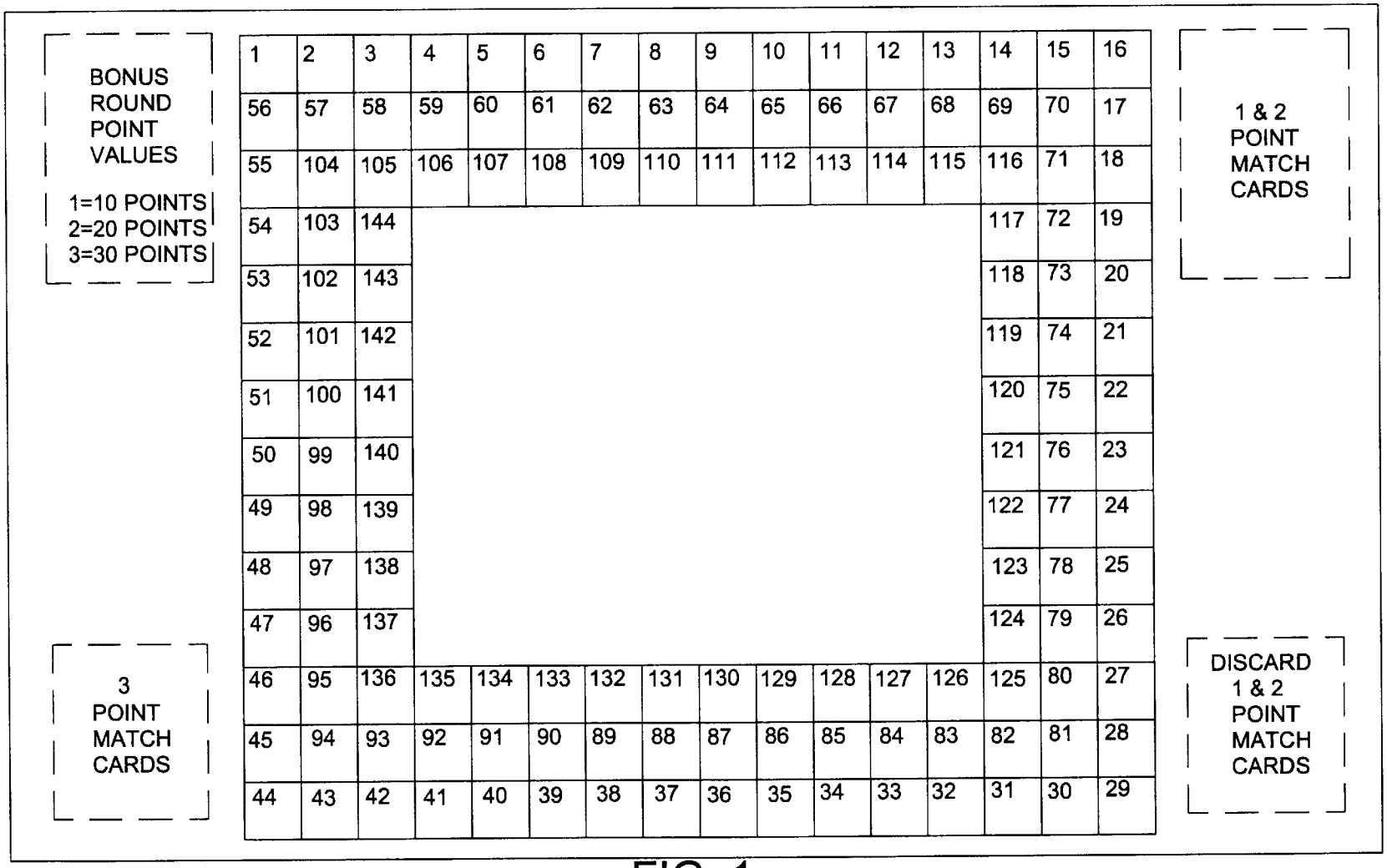
FIG. 1 is a top plan view of a game board of the matching game of the present invention.

The apparatus of the matching game of the present invention, generally illustrated in FIGS. 1 to 8, includes a game board 12, a six-sided die 14, a deck or plurality of 1 & 2 point match cards 16, a deck or plurality of 3 point match cards 18, a plurality of answer ballots 20 and a plurality of game pieces 22. The idea of the matching game of the present invention is to fill in the blank space or complete the incomplete expression on the match cards utilizing one's knowledge of the English language and thought process when triggered by the key words on the match card. When teammates write down the same word to fill in the blank on the match card, then a match is made and points are awarded corresponding to the previous roll of the die 14. The game board 12 is used to keep track of the points for each team.

The Game Board

The game board 12 illustrated in FIG. 1 preferably is constructed in a conventional manner, with conventional materials and folds into four rectangular substantially flat sections for easy storage. Each rectangular section or quadrant is approximately 18½ inches by 9¼ inches. When completely unfolded, the game board 12 is approximately 37 inches by 18½ inches. However, it should be appreciated that the game board of the present invention could be of different sizes, shapes and configurations. The background of the game board 12 is preferably white although it could be other colors. The game board 12 may include indicia (not shown) consisting of the name of the game, the trademark associated with the game and/or a logo associated with the game (collectively, the "game logo"). The game logo may be in the center of the game board 12 and/or in other suitable places on the top surface 12*a* and bottom surface (not shown) of the game board 12. The game board 12 includes one hundred forty four consecutively numbered substantially square spaces 24. Each space is preferably 1 inch by 1 inch. The spaces are numbered from one to one hundred forty four starting in the top left quadrant of the game board 12 and proceeding clockwise and inwardly, as illustrated in FIG. 1. It should be appreciated that the number of the spaces could vary depending on the point values for the matches and that the size and shape of the spaces could vary.

The game board 12 includes an area 26 for the deck of unused 1 & 2 point match cards, an area 28 for the discarded or used 1 & 2 point match cards, an area 30 for the deck of unused 3 point match cards, and an area 32 for discarded or used 3 point match cards which also includes a description of the bonus round point values. More specifically, the area 26 in the upper right hand quadrant has following indicia:

1 & 2
POINT
MATCH
CARDS

The 1 & 2 point match cards 16 are placed logo side up in this area 26 for use during the matching game. The top card is picked from this pile when either a one or two is rolled on the die as described below. The area 28 in the lower right hand quadrant has the following indicia:

DISCARD
1 & 2 POINT
MATCH CARDS

The 1 & 2 point match cards used or discarded during the matching game are placed in this area 28. The area 30 in the lower left hand quadrant has the following indicia:

3
POINT
MATCH
CARDS

The 3 point match cards 18 are placed logo side up in the area 30 for use during the game. The top card is picked from this pile when a three is rolled on the die 14 during a regular round, and during the bonus round as described below. The upper left hand quadrant of the game board 12 includes the following indicia which indicates the points in the bonus round:

BONUS
ROUND
POINT
VALUES
1=10 POINTS
2=20 POINTS
3=30 POINTS

This reminds the players of the points in the bonus round.

It should be appreciated that the areas for the cards could changed and that the cards could be stored for use, and after use, in holders or positions not on the board.

The Die

The die 14 is a conventional die with six sides, except that two of the sides include one dot, two of the sides include two of the dots and two of the sides include three dots. The three sides not shown have identical markings The number of dots correspond to the numbers on the match cards. Thus, if the reader rolls a one on the die 14, during the reader's turn a match is worth one point and the first incomplete expression on the 1 & 2 point match card 16 is read or played. If a two is rolled with the die, during the reader's turn a match is worth two points and the second incomplete expression on the 1 & 2 point match card is read or played. If a three is rolled with the die, during the reader's turn a match is worth three points and the incomplete expression on the 3 point match card is read or played.

The Match Cards

The 1 & 2 point match cards 16 are preferably colored yellow cards although it should be appreciated that they could be any color. The 1 & 2 point match cards 16 are worth either one or two points, depending upon the roll of the die. The top surface 16*a* of each 1 & 2 point match card 16 has the game logo as illustrated in FIG. 3 and indicia indicating that the card is a 1 & 2 point match card. The bottom surface 16*b* of each 1 & 2 point match card 16 has one incomplete expression or phrase per card, as illustrated in FIG. 4. The incomplete expression has a blank underlined space and one or more words. This example card reads "Class _." If a one is rolled with the die, a match in regular round is worth one point per match and the expression "Class _" is played (i.e., "read by the reader"). If a two is rolled with the die, a match in the regular round is worth two points per match and the same expression is played.

In this preferred embodiment of the matching game, the 3 point match cards 18 are colored pink although it should be appreciated that they could be any color. The 3 point match cards 18 are worth three points and are read or played when a three is rolled on the die and during the bonus round. The top surface 18*a* on each 3 point match card 18 has the game logo as illustrated in FIG. 5 and indicia indicating that the card is a 3 point match card. The bottom surface 18*b* of each 3 point match card 18 has an incomplete expression as illustrated in FIG. 6. The example card in FIG. 6 has the incomplete expression or phase "Don't forget to change the _".

The players attempt to complete the incomplete expression on the match cards based upon one's knowledge of the English language and the person's thought process of choosing a word to complete the incomplete expression on the match card.

The Answer Ballot

The players record their answers to the incomplete expressions on the match cards on the answer ballot 20. The answer ballots 20 have a place for each answer a player may give during the matching game as Illustrated in FIG. 7. The answer ballot preferably consists of four long lines, labeled "1", "2", "3" and "Bonus", followed by three columns of four shorter lines. When a player is the reader, he or she writes the answer on the long lines, labeled 1", "2" and "3" and "Bonus", respectively for each round. The reader's teammates write their answers in the lower columns when they are trying to match the reader. For example, for the first regular round, the reader writes his or her answer on the long line labeled "1" and the reader's teammates write their answers in the shorter lines in the first column when they are trying to match the reader's answer. The answer ballot 20, thus has enough spaces for all of the rounds when there are four players or less on each team. It should be appreciated that additional lines could be added to the answer ballot if there are more rounds or more players.

The Game Pieces

Each team chooses a game piece 22 which represents the team on the game board. The teams move the pieces around the game board to keep track of points earned by the teams during the matching game. The teams move around the square spaces 24 on the game board 12 corresponding to the number of points earned for matching answers with the reader. A pin shaped game piece 22 is illustrated in FIG. 8; however, it should be appreciated that the game piece could be of an alternative configurations, sizes or shapes. There are preferably at least six game pieces, preferably each of a different color. Each game piece has an area 23 for a game logo. Everyone playing the game is aware of how their team stands pointwise compared to the other teams by simply looking at the board, and thus eliminates the need to keep a written account of the points of each team and eliminates the need for the players to keep checking the scores of the other teams. This increases the speed and excitement of the matching game.

Playing the Matching Game

The teams should be divided into equal number of players, if possible. For example, if there are twelve people playing the matching game, the following are all options for dividing into teams: there can be six teams with two people on each team, four teams with three people on each team, three teams with four people on each team or two teams with six people on each team. With more people on a team, the odds are increased for matching the reader's answer. A minimum of four people, which would consist of two teams with two players on each team, is necessary to play the matching game.

The matching game is thus played by four or more players divided into at least two teams. The players preferably sit in an alternating fashion by teams. The overall object of the matching game is for a team to advance the furthest on the board 12 by obtaining points by matching the answer given by the player reading the incomplete expression. As mentioned above, the player reading the match card is called the "reader." The players on each team takes turns being the reader of the incomplete expressions on the match cards 16 or 18. The team members of the reader must match the reader's answer to obtain points. After three regular rounds and one bonus round, the team which has advanced further on the board, which is the team with the most points, wins the game.

More specifically, to play the first round of the game, the first player or reader rolls the die 14. The number of the roll represents the point value of each match and the match card to be selected. If the reader rolls a one, the value of each match is worth one point. If the reader rolls a two, then the value of each match is worth two points. If the reader rolls a three, the value of each match is worth three points. Additionally, if the reader rolls a one or a two, the player picks a card from the deck of 1 & 2 point match cards 16. If the reader rolls a three, the reader picks a card from the deck of 3 point match cards 18. The reader reads the incomplete expression on the selected match card. Players may also see the incomplete expression on the chosen card.

For example, the chosen card may read "Class __." The reader, writes down his or her answer in the space labeled "1" on the answer ballot and the other players on the reader's team write down their answers on the first line of the first column on the bottom of their answer ballots 20. The team members are not allowed to discuss their answers. After each member in the reader's team writes down their answer, the reader and the reader's teammates reveal their answers. For each team member and reader which have matching answers, the team earns the appropriate amount of points based on the value of the match determined by the previous roll of the die The team moves its game piece along the board according to the number of points earned. For example, if the reader rolled a two, then he or she would pick the top 1 & 2 point match card 16 and write down his or her answer on the appropriate space on the answer ballot. If two of the reader's teammates wrote down the same answer, then that team would have earned four points (two matches at two points per match) and would move their game piece ahead four spaces 24 on the game board 12. If two teammates match each other but not the reader, no points are awarded. Points are only awarded per match with the reader. This process is repeated for each player on each team, wherein the teams alternate turns. After each player on each team has been the reader, the second regular round begins.

After three complete regular rounds wherein each player has been the reader a total of three different times, the bonus round starts. Each team selects who they want to be their reader for the bonus round. In the bonus round, the team farthest behind goes first followed by the next team and the team who is ahead after the first three rounds goes last. In the event of a tie after the regular three rounds, then each team rolls the die to see who goes first, the higher number goes first. The reader from the appropriate team then randomly selects a 3 point match card 18 and rolls the die 14. The outcome of the die roll determines the point value for the bonus round for that team. If the reader rolls a one, the value of each match is worth ten bonus points. If the reader rolls a two, the value of each match is worth twenty bonus points. If the reader rolls a three, the value of each match is worth thirty bonus points. As mentioned above, area 32 on the game board 12 reminds the players of these point values.

The reader reads or shows the selected 3 point match card to the reader's teammates. The reader and the reader's teammates then write down their answers on the answer ballots 20 in the appropriate spaces. Once all teammates have written their answer, then they will show their answers and see if any of the teammates matched the reader. If two teammates matched the same answer as the reader then that team is awarded sixty points (two matches at thirty points per match). The team moves their game piece on the game board 12 corresponding to the number of bonus points earned per match. For example, if the reader rolls a two on the die and two of his or her teammates match answers with him or her, then that team would be awarded forty bonus points (two matches at twenty points per match) and would then move their game piece ahead forty squares on the game board.

In the event that a team scores more than one hundred forty four points in a game, the additional points maybe tallied on a separate piece of paper. After the bonus round is complete, the team with the most points, that is, farthest along on the game board, wins the game.

In another embodiment of the method of the present invention, the 1 & 2 point match cards contains two incomplete expressions per card. In this embodiment, when the reader rolls a one on the die, the reader reads the first incomplete expression on the 1 & 2 point match card and when the reader rolls a two on the die, the reader reads the second incomplete expression on the 1 & 2 point match card.

While the present invention has been described in connection with what is presently considered to be the most practical and preferred embodiments, it is to be understood that the invention is not limited to the disclosed embodiments, but on the contrary is intended to cover various modifications and equivalent arrangements included within the spirit and scope of the claims. It is thus to be understood that modifications and variations in the present invention may be made without departing from the novel aspects of this invention as defined in the claims, and that this application is to be limited only by the scope of the claims.

The invention is hereby claimed as follows:

1. An apparatus for playing a matching game in which at least two teams having at least two players on each team compete against each other, said apparatus comprising:

a game board having a plurality of numbered spaces thereon;

a plurality of game pieces which represent each of the teams;

a plurality of match cards having at least one incomplete expression thereon; and a plurality of answer ballots with blank spaces for each of the players to write their answers to the incomplete expression.

2. The apparatus of claim 1, wherein the match cards include a plurality of 1 & 2 point match cards and a plurality of 3 point match cards.

3. The apparatus of claim 2, wherein the 1 & 2 point match cards have one incomplete expression.

4. The apparatus of claim 2, wherein the 1 & 2 point match cards have more than one incomplete expressions or phrases.

5. The apparatus of claim 2, wherein the game board includes one-hundred forty four consecutively numbered spaces.

6. The apparatus of claim 5, which further includes a six-sided die having two sides with one dot, two sides with two dots and two sides with three dots.

7. The apparatus of claim 6, wherein the answer ballot includes a space for the players to write their answers in each of the rounds.

8. A game apparatus for playing a matching game, comprising: a game board, match cards, an answer ballot and game pieces, wherein said match cards comprise a deck of 1 & 2 point match cards having at least one incomplete expression per card and a deck of 3 point match cards having at least one incomplete expression per card.

9. The game apparatus of claim 8, wherein said game board includes one hundred forty four spaces for advancement.

10. The game apparatus of claim 9, wherein said game board further includes an area for unused 1 & 2 point match cards, an area for used 1 & 2 point match cards, an area for unused 3 point match cards and an area for used 3 point match cards.

11. A game apparatus for playing a matching game, comprising: a game board, a die, match cards, an answer ballot and game pieces, wherein said match cards comprise a deck of 1 & 2 point match cards and a deck of 3 point match cards, and said die is a six-sided die having two sides with one dot, two sides with two dots and two sides with three dots.

12. A method of playing a matching game, said method comprises the following steps:

(a) selecting at least two teams comprised of at least two players per team;

(b) selecting a player from a team to be a reader, (c) selecting one of a plurality of match cards;

(d) communicating an incomplete expression on the selected match card to the reader and the reader's teammates;

(e) the reader and each player of the reader's team writing down their answers to the incomplete expression;

(f) comparing the answer of the reader with the answers of the reader's teammates;

(g) determining points to be awarded to the readers' team based on the number of matches of the answer of the reader and the answer of the reader's teammates;

(h) repeating steps (b) through (g) for each player on each team, whereby each player has had a turn at being a reader and the teams rotate turns; and (i) determining the winner of the matching game.

13. The method of claim 12, which further includes the steps of:

(j) the reader rolling a die to determine if the reader selects a 1 & 2 point match card or a 3 point match card; and (k) determining the points to be awarded to the readers' team based on the number of matches of the answer of the reader and the answer of the reader's teammates multiplied by the number of the roll on the die.

14. A method for playing a matching game with a game board, a die, match cards, an answer ballot and game pieces, comprising the steps of:

(a) selecting at least two teams comprised of at least two players per team;

(b) selecting a game piece for each team;

(c) selecting a player from a team to act as a reader;

(d) rolling the die and determining the value of the match in the first regular round;

(e) selecting a match card based on the outcome of the roll of the die, wherein the match card contains an incomplete expression;

(f) the players on a team answering the incomplete expression of the match card on the answer ballots;

(g) comparing the answer of the reader with the answers of the reader's teammates;

(h) calculating points to be awarded according to the value of the match and the number of correct answers of the reader and the reader's teammates;

(i) advancing the game piece on the game board according to the number of points awarded to the team;

(j) repeating step (c) to step (i) for each team;

(k) completing the first regular round of the match by repeating steps (c) to step (j) until each player on each team has had a turn as the reader;

(l) completing at least one more regular round; and (m) determining the team with the most awarded points.

15. The method of claim 14, which further includes the steps of:

(n) after the regular rounds and prior to determining the winner of the game, selecting a reader from a team in a bonus round;

(o) the reader rolling the die and determining the value of the match in the bonus round;

(p) selecting a match card based on the outcome of the roll of the die, wherein the match card contains an incomplete expression;

(q) answering the incomplete expression of the match card on the answer ballot;

(r) comparing the answer of the reader with the answers of the reader's teammates;

(s) calculating points to be awarded according to the value of the match and the number of correct answers of the reader and the reader's teammates;

(t) advancing the game piece on the game board according to the number of points awarded to the team; and (u) repeating step (n) to step (t) for each team.

16. The method of claim 15, wherein the value of the bonus round is ten times the outcome of the roll of the die.

17. The method of claim 14, wherein said game board includes at least one hundred forty four spaces for advancement.

18. The method of claim 17, wherein said game board further includes an area for unused 1 & 2 point match cards, an area for used 1 & 2 point match cards, an area for unused 3 point match cards and an area for used 3 point match cards.

19. The method of claim 14, wherein said die is a six-sided die having two sides with one dot, two sides with two dots and two sides with three dots.

20. The method of claim 14, wherein said match cards comprise a deck of 1 & 2 point match cards and a deck of 3 point match cards.

21. The method of claim 20, wherein said 1 & 2 point match cards contain at least one incomplete expressions per card.

22. A game apparatus for playing a matching game, said game apparatus comprising: a game board having a plurality of numbered spaces, at least one deck of match cards each having at least one incomplete expression, an answer ballot for enabling players to write down their answers to the incomplete expressions on the match cards, and game pieces adapted to be placed on the numbered spaces to keep track of matches to the incomplete expressions on the match cards by the players.

* * * * *